US005409534A

United States Patent [19]

Kustermann

[11] Patent Number: 5,409,534

[45] Date of Patent: Apr. 25, 1995

[54] DEVICE FOR COATING MOVING WEBS OF PAPER OR BOARD

[75] Inventor: Martin Kustermann, Heidenheim, Germany

[73] Assignee: J. M. Voith GmbH, Heidenheim, Germany

[21] Appl. No.: 185,986

[22] PCT Filed: May 11, 1993

[86] PCT No.: PCT/EP93/01162

§ 371 Date: Jan. 11, 1994

§ 102(e) Date: Jan. 11, 1994

[87] PCT Pub. No.: WO93/23622

PCT Pub. Date: Nov. 25, 1993

[30] Foreign Application Priority Data

May 12, 1992 [DE] Germany ..... 92 06 355.1

[51] Int. Cl.[6] ..... B05C 1/00

[52] U.S. Cl. ..... 118/201; 118/205; 118/231; 118/232; 118/257

[58] Field of Search ..... 118/200, 201, 205, 230, 118/231, 232, 233, 235, 244, 246, 248, 249, 250, 251, 256, 258, 262, 253, 257, 106

[56] References Cited

U.S. PATENT DOCUMENTS

| | | | |
|---|---|---|---|
| 4,027,623 | 6/1977 | Adler | 118/108 |
| 4,892,057 | 1/1990 | Zimmer | 118/248 |
| 5,253,495 | 10/1993 | Zimmer | 118/249 |
| 5,255,539 | 10/1993 | Zimmer | 118/249 |

FOREIGN PATENT DOCUMENTS

| | | | |
|---|---|---|---|
| 0403845 | 12/1990 | European Pat. Off. | 118/231 |
| 3620374 | 2/1987 | Germany | 118/235 |
| 4100771 | 7/1991 | Germany . | |
| 2107222 | 4/1983 | United Kingdom . | |

*Primary Examiner*—W. Gary Jones
*Assistant Examiner*—Mark De Simone
*Attorney, Agent, or Firm*—Ostrolenk, Faber, Gerb & Soffen

[57] ABSTRACT

The invention relates to a coating device for coating moving webs of material, more particularly webs of paper or board, comprising a belt or hose (7), which is trained about the curved guide surface of a beam- or rod-like support member (1) and a drive roll (6), a cooperating roll (C) carrying the web, a coating gap (9) being defined between the cooperating roll (C) and the hose (7) for the application of the coating material to the web or the roll, a support beam (3), which extends in parallelism to the roll and the drive roll (6), for supporting the support member (1), and between the same a pressure hose (4) for the transmission of the support forces. The invention is characterized in that the support member (1) possesses a rib- or rail-like extension in its part remote from the curved guide surface at the gap (9), on which there acts a further pressure hose (5 and 5') arranged between a corresponding support surface on the support beam (3) and the extension of the support member (1), essentially in a direction which is transverse in relation to the direction of action of the first pressure hose (4 and 4'), the first pressure hose (4 and 4') being arranged essentially at the free end of the extension (2 and 2') of the support member (1 and 1').

12 Claims, 1 Drawing Sheet

DEVICE FOR COATING MOVING WEBS OF PAPER OR BOARD

The invention relates to a coating device for coating a paper web, or the like web of material, and particularly to a belt coater and to the support for the belt at the coating nip or gap. The coating belt is trained around a curved guide surface of a support, the guide surface being at the coating gap. The support is supported on a rail. Pressure means, like a hose, between the support and the rail keeps the guide surface at a preferred orientation.

German patent publication DE 41 00 771 A1 discloses such a device. In this case, the pressure hose serves to compensate for bending or to adjust the bend for the support member with the curved guide surface. Variations in hydrodynamic forces, occurring along the web, on the support member in the course of the coating operation however the support member to bend so that equalization of such flexure is necessary.

This object of equalizing such flexure is to be attained with the invention. The coating device of the invention is used for coating moving webs of material, more particularly webs of paper or board. An endless belt is trained to pass over a curved guide surface of a beam or rod-like support member. A drive roll drives the belt to move over the curved guide surface. A cooperating web supporting roll supports the web near to the belt at the curved guide surface to define a coating gap between them. A support beam extends parallel to the web supporting roll and supports the support member. First pressure means are disposed between the support member and the beam to apply force to the support member in a direction toward the coating gap and the web supporting roll. Second pressure means are disposed at the one side of the support member and at the support beam as to apply a force essentially in a direction transverse to the direction of force applied by the first pressure means and also opposing the force applied on the support member by the belt moving through the coating gap and applying coating on the guide surface. The first and second pressure means may be pressure hoses or other pressure applying means such as piezo translators, hydraulic pistons operating in pressure cylinders, thermally or magnetically driven servo elements. The drive means for the belt comprises one drive roll in the belt which has a diameter and radius of curvature significantly larger than the radius of curvature of the curved guide surface.

In order to aid in relative shifting of the support member, particularly with reference to the second pressure means, the second pressure means, such as a pressure hose, is in contact with an intermediate member disposed between the second pressure means and the support member. The intermediate member and the extension of the support member are mutually smooth and slidable with respect to each other to absorb relative sliding motion of the support member with respect to the support beam.

It is an advantage if only one single drive roll is provided for the belt or, respectively, for the hose, because then the radius of curvature of the guide surface of the support member may be designed to be relatively small, something which is very desirable. It is furthermore possible to have two guide or drive rolls for the hose, the diameter of such rolls being able to be 400 and 900 mm. It is then naturally possible for the curvature radius of the guide surface of the support member not to be so small.

BRIEF DESCRIPTION OF THE DRAWINGS

In what follows the invention will be described with reference to the figures which illustrate preferred embodiments; the FIGS. 1 and 2 are diagrammatic cross sections taken through the coating device and, respectively, on a larger scale through another working embodiment.

Instead of such pressure hose it is furthermore possible to have suitable rows of piezotranslators or of thrust pistons running in pressure cylinders. One manufacturer of such piezotranslators is the company PI Physik Instrumente GmbH, of Siemensstrasse, 76337 Waldbronn, Germany.

Coating is performed using the belt or the hose 7, which is drawn through a trough 12 containing the coating material (in liquid form).

Figure 1:
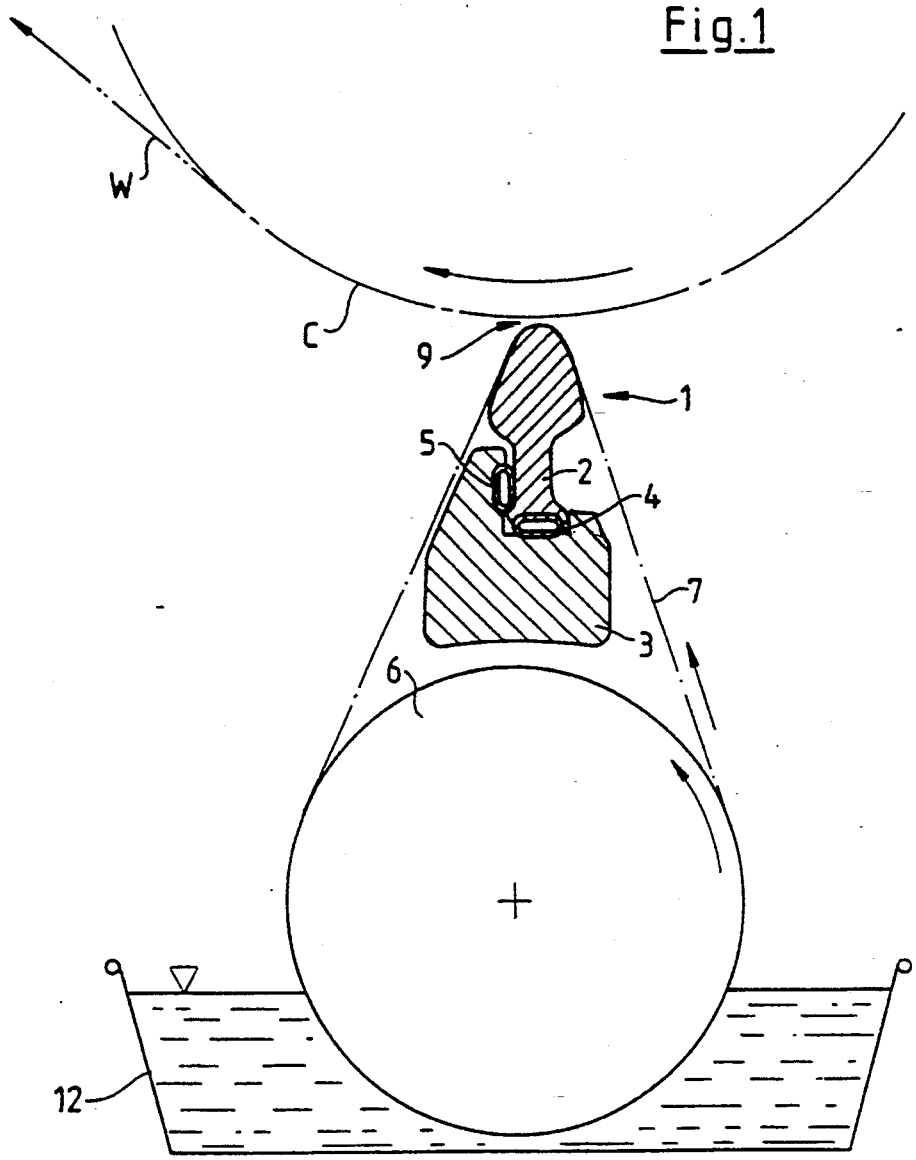
As shown in FIG. 1 the rail- or beam-like support member 1 is arranged to be parallel to a cooperating roll C on which the web travels through the coating gap or nip. The member 1 is supported by a beam 3 which is beneath and parallel to the support member 1, such supporting action is first achieved by a pressure hose 4 arranged at the end of a rib- or rail-like downward extension 2 of the support member 1. At a coating gap or nip 9 defined by the curved end of the support member and the cooperating roll the support member 1 possesses a curved guide surface for an endless loop coating belt or hose 7. The belt is trained around a drive roll 6. The diameter of this drive roll preferably amounts to between 400 and 900 mm and the radius of the guide surface of the support member 1 may be between 40 and 150 mm. On the rib-like extension 2 of the support member 1 there acts a further pressure hose 5, such action being transverse in relation to the line of action of the first pressure hose 4. Further, the further pressure hose is on the side of the extension 2 that is downstream of the web movement to oppose the downstream direction force on the support member 1. Accordingly the bending of the support member 1 may be altered and if necessary adjusted or equalized both in the vertical and in the horizontal direction by the pressure hoses 4 and 5, respectively.
Figure 2:
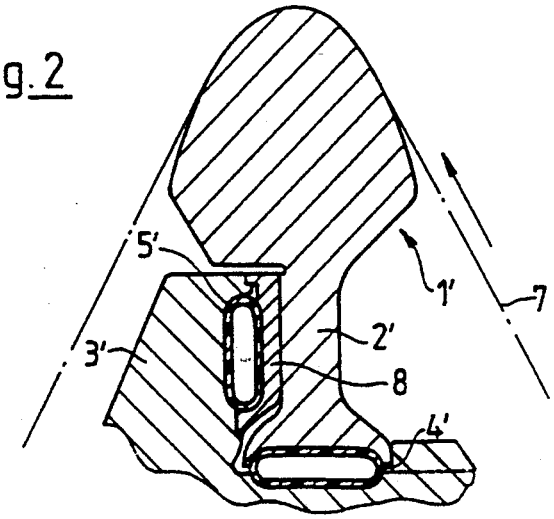

As shown in FIG. 2 between the additional hose 5' and the rail-like extension 2' of the support member 1' an intermediate plate 8 is arranged. Providing that the contact surfaces of the extension 2' and the intermediate plate 8 are given a very smooth finish, there will only be a slight hinderance of the shaping, to be obtained owing to the pressure hose 5', of the support member 1', caused by material of the pressure hose 5', which in certain circumstances may have a relatively high coefficient of friction. This intermediate member may also be employed to reduce the area moment of inertia of the rail-like extension 2 or, respectively, 2' in order to minimize the bending forces which have to be produced by the pressure hose 4 or, respectively, 4'. This intermediate plate 8 is held at its two end edges, which are illustrated in the figure, by projections in a freely movable fashion on the support beam 3'.

Owing to the employment of a second pressure element, whose force is practically exerted transversely in relation to that of the first pressure element, it is also possible to compensate for the additional bending of the support member 1, which results owing to the variations in hydrodynamic pressure in the course of the coating operation.

I claim:

1. A coating device for coating a moving web of material comprising a web support roll for supporting a web to be coated;

a support member extending parallel to the web support roll; the support member including a curved guide surface extending toward the support roll;

a coating belt in sliding contact with said curved guide surface of said support member;

means for driving the belt to slide around the curved guide surface in a moving direction and for tightening the belt over the guide surface as the belt moves thereover;

the guide surface being spaced from the web support roll to define a coating gap between the belt and the web wherein coating material travelling on the belt is brought to coat the web moving past on the web support roll in the coating gap;

a beam for supporting the support member and also extending parallel to the web support roll;

first pressure means disposed between the support member and the beam and positioned for opposing force on the support member directed away from the web supporting roll;

the support member having an extension extending away from the curved guide surface and the web support roll; second pressure means disposed between the extension and the beam at a side of the extension of the support member so as to oppose movement of the support member generally in a direction transverse to the direction of force applied by the first pressure means.

2. The coating device of claim 1, wherein the first pressure means comprises a first pressure hose disposed between the support member and the beam, and the second pressure means comprises a second pressure hose disposed between the support member and the beam such that when the first and second hoses are pressurized, they exert greater pressure on the support member in their respective directions of force application.

3. The coating device of claim 1, wherein the extension of the support member has a free end away from the curved guide surface of the support member; and the first pressure means is disposed between the support member and the support beam at the free end of the extension of the support member.

4. The coating device of claim 3, wherein the extension is a rail-like extension away from the curved guide surface and from the web supporting roll.

5. The coating device of claim 4, wherein the support beam includes a first surface which extends generally across the direction that is away from the web supporting roll and away from the guide surface, and the first pressure means is disposed at the first surface; and a second surface transverse to the first surface and extending in the direction away from the web support roll and the guide surface and the second pressure means is disposed at the second surface.

6. The coating device of claim 4, wherein the first pressure means comprises a first pressure hose disposed between the support member and the beam, and the second pressure means comprises a second pressure hose disposed between the support member and the beam such that when the first and second hoses are pressurized, they exert greater pressure on the support member in their respective directions of force application.

7. The coating device of claim 6, further comprising a rail-like intermediate member disposed between the second pressure hose and the extension of the support member, and the intermediate member is supported to extend parallel to the second pressure hose and to be free movable with respect to the beam, the intermediate member and the extension of the support member being in contact with each other by respective smooth and relatively slidable mutual contact surfaces thereon.

8. The coating device of claim 1, wherein the means for driving the belt comprises a rotatable drive roll in engagement with the belt and rotatable for moving the belt to bring coating material to the coating gap.

9. The coating device of claim 8, wherein there is a single one of the drive rolls for the coating belt.

10. The coating device of claim 9, wherein the drive roll has a diameter in the range between 400 and 900 mm; and the curved guide surface of the support member has a radius of curvature that is in the range of 10 to 150 mm.

11. The coating device of claim 10, wherein the guide surface of the support member has a radius of curvature in the range of 20 to 80 mm.

12. The coating device of claim 1, wherein the first and second pressure means are selected from the group consisting of piezo translators, hydraulic pistons and respective pressure cylinders, and thermally driven servo elements and magnetically driven servo elements.

* * * * *